United States Patent [19]

Schmodde et al.

[11] Patent Number: 4,554,803

[45] Date of Patent: Nov. 26, 1985

[54] FLAT-BED KNITTING MACHINE HAVING ELECTRO-MECHANICAL SELECTION

[75] Inventors: Hermann Schmodde, Albstadt; Hans-Günter Haltenhof, Pfullingen, both of Fed. Rep. of Germany

[73] Assignee: H. Stoll GmbH & Co., Fed. Rep. of Germany

[21] Appl. No.: 702,757

[22] Filed: Feb. 19, 1985

[30] Foreign Application Priority Data

Feb. 25, 1984 [DE] Fed. Rep. of Germany ..... 3406870

[51] Int. Cl.[4] ..... D04B 15/66

[52] U.S. Cl. ..... 66/75.2

[58] Field of Search ..... 66/75.2, 75.1

[56] References Cited

U.S. PATENT DOCUMENTS

| | | | |
|---|---|---|---|
| 4,041,732 | 8/1977 | Krause | 66/75.2 |
| 4,100,767 | 7/1978 | Schieber et al. | 66/75.2 |
| 4,214,460 | 7/1980 | Shima | 66/75.2 |
| 4,481,793 | 11/1984 | Cuche et al. | 66/75.2 |
| 4,490,994 | 1/1985 | Essig | 66/75.2 X |

*Primary Examiner*—Ronald Feldbaum

*Attorney, Agent, or Firm*—Jones, Tullar & Cooper

[57] ABSTRACT

A flat-bed knitting machine with a plurality of needle beds in each of which an intermediate plate is situated which is displaceable between four operating positions to thereby control the movement of an associated needle. Also located in each needle bed are pairs of selector plates and associated with each needle bed is an electromagnetic selecting device which controls the location of the selector plates as a function of the knitting pattern relative to a cam track assembly and the intermediate plate associated with the selector plates.

35 Claims, 20 Drawing Figures

FLAT-BED KNITTING MACHINE HAVING ELECTRO-MECHANICAL SELECTION

TECHNICAL FIELD

The present invention relates to a flat-bed knitting having intermediate plates located to move longitudinally in needle beds and control the longitudinal movement of the needles. The needles can be struck by selector plates controlled in accordance with the knitting pattery by means of an electro-magnetic selecting device which operates in conjunction with a drive cam track.

PRIOR ART

For a flat-bed knitting machine of the type disclosed in DE-OS (German laid open application) No. 28 42 054 equipped with an electro-mechanical needle selection a single selector plate is provided which, in the selected condition, can push an intermediate plate designed as a trigger from a rear nominal position into the most forward position of two further operating positions by means of an ejector cam track. The center operating position of the intermediate plate is achieved by its combined operation with a semi-return cam (resetting cam). With this disclosed flat-bed knitting machine a total of only three positions from a collective total of five desired combinations for the intermediate plate are attainable, and furthermore, the center position can only be achieved via a diverse path over the most forward position from the rear nominal position. This means, with regard to the first point, that the individual cams on the cam box carriage have to be locally withdrawn from each other, i.e., knitting cams and transfer cams have to be arranged in each case at a distance from each other, which widens the carriage and necessitates additional selection devices. Even on the basis of the second point widening of the carriage is necessary, since the semi-return cam necessary for the center position has to be accommodated in front of one of the cam parts.

Indeed, it is disclosed in DE-OS No. 20 02 991 that selector plates have been arranged in more than three differing operating positions, but these operating positions have been specified as being an arrangement having several moving selector plates next to each other possessing offset butts. As a consequence, a selection is made only by the switch cams as a result of whether these selector plates come in contact or not with a trigger cleat. It can be seen that this signifies a a considerable expenditure on selector plates and cam parts. The same applies to the flat-bed knitting machine disclosed in DE-OS No. 20 21 742, for which, in addition two selector plates are provided, arranged one over the other, whereby once again several selector plates are arranged next to each other and are provided with echeloned butts. Furthermore, it is common to both disclosed flat-bed knitting machines that neither of them are equipped with an electro-mechanical selection device, but have a Jacquard patterning mechanism.

SUMMARY OF THE INVENTION

It is therefore an object of the present invention to provide a flat-bed knitting machine having electro-mechanical pattern selection of the type noted above, on which more than three operating positions of the intermediate plates can be occupied and on which each of the additional operating positions can be reached directly from the first operating, or nominal position.

This object is achieved for a flat-bed knitting machine of the mentioned type in which each intermediate plate is associated with at least a first and second selector plate, which are designed such and arranged relative to each other such that the intermediate plate can be moved longitudinally from a nominal position immediately into one of at least three further operating positions in dependence upon the slection of the first and/or second selector plate.

It is possible, with the aid of the first and second selector plate to achieve a total of four operating positions (inclusive of the nominal position) of five required positions for non-knitting, transfer acceptance, tuck and knit and transferring over. If, as is possible, in a similar manner, one or several selector plates were provided, then additional selected operating positions would be possible. Commencing from the nominal position all other operating positions can be reached directly by a corresponding selection of the selector plates, i.e., approached without diversion. In general, this means that in using separated knitting and transfer cams these can be brought close together, because no additional selection is now required between them. This means additionally that so-called combined cams can advantageously be adopted, for which the transfer cam part is integrated in the knitting cam part. Once again, this means that, for example, on a carriage provided with a double cam in the form of two combination cams arranged next to each other only a minimum number of electro-mechanical selection devices have to be provided. The width of the carriage is therefore consideraly reduced.

In accordance with a preferred embodiment of the present invention the first and second selector plates are arranged in the longitudinal position of movement of the needles one behind the other, whereby the first selector plate is arranged between the second selector plate and the intermediate plate. This means, that as before, the individual selector plates can be arranged, just like the needles, directly and closely next to each other.

According to a variant of this first preferred embodiment, a first ejector cam track is directly associated with the first selector plate and a second ejector cam track to the second selector plate, whose drive cam height differs. The "offer elements" for the selection of the selector plates for this variant are arranged such that they press down the butts of the plates in conjunction with the ejector cam tracks into the "offer position", which is equal to the non-selected position, which means that the butts of the non-selected plates can pass through under the cam parts featuring the ejector cam tracks, so that along this cam part no switching part need be provided.

According to another variant of the first preferred embodiment, a common ejector cam track is associated with the first and second selector plates. For this variant, it is particularly advantageous if the first and second selector plates are connected to a connector plate, which is longitudinally moveable by a drive plate, which is connected with the ejector cam track. As a result, there is a saving made on cam parts, especially if the drive plate is forcibly guided in the ejector cam track and in the return cam track, as is additionally provided for as a preferred method. The drive plate continues to effect the sliding motion as a result of this, irrespective of whether or which of the selector plates is selected.

The "offer motion" for the selection of the selector plates can, in so doing, be effected by "offer elements" arranged on the carriage, or by the drive plate executing an additional sliding action as a result of the "offer motion", preferably in the opposite direction.

According to a second preferred embodiment of the present invention, the first and second selector plates are arranged parallel to each and transverse to the longitudinal direction of movement of the needles and operate on a common intermediate plate. As a result, a lesser design depth of the needle bed is achieved with respect to the first exemplary embodiment. The first and second selector plates have, preferably, differing lengths and can be connected/brought into contact at their rear ends with each other for movement, the ends of which are associated with a common ejector cam track. With this preferred embodiment the "offer elements" are arranged such that the "offer position" of the selector plates is equal to the non-selected position.

The present invention can also be utilized to achieve a multiplicity of operating positions for the intermediate plate with such cams, for which differing cam tracks can be effected with the aid of switch cams acting in the path of the needle butts. It is also possible to utilize the present invention where the differing cam tracks are so described that the needle butts remain projecting from the needle bed or are pressed into the needle bed, such that they can pass beneath the cam parts. In other words, the intermediate plate can either take the form of needle jacks acting on the needles take the form of a trigger plate, with whose help the needle butts or butts of intermediate arranged needle plates can be pressed in the needle bed.

Further details and refinements of the present invention can be taken from the following description in which the present invention is explained and described in more detail with the aid of several preferred embodiments shown in the drawings:

DETAILED DESCRIPTION OF THE PREFERRED EMBODIMENTS

Figures 1A, 1B, 1C:
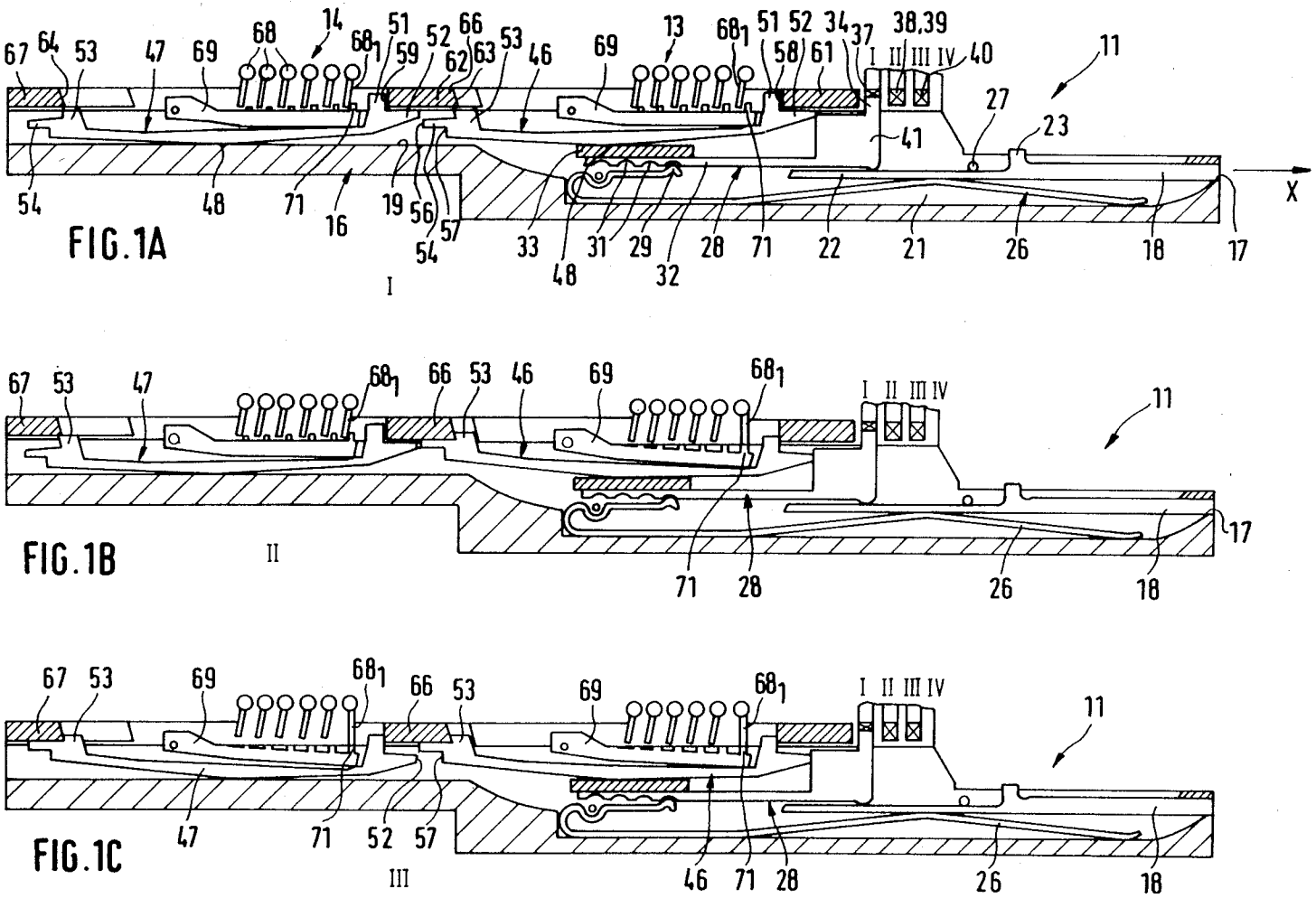
FIGS. 1A to 1D: illustrate a mechanism for selecting the operating positions of knitting needles on flat-bed knitting machines according to a first preferred embodiment of the invention, for which the individual part illustrations show the various operating positions.

The mechanisms 11, 11', 11'', 11''' and 111 shown in the drawing are for selecting possible operating positions of intermediate plates 28, 28', 28'', 28''' and 128 influencing the knitting needles, not illustrated, on flat-bed knitting machines, whereby the intermediate plates are designed, depending upon the type and construction of the cam box carriage and its cams, either in the form of jacks acting directly on the knitting needles, or, in the form of trigger plates acting on a needle plate arranged in front of the knitting needle. According to the present invention, electro-magnetic selection devices 13, 14 and 113, 114 are provided.

According to FIG. 1A, which shows a view in section through one of the needle beds 16 arranged in a V-shape to each other, a needle plate 18 is arranged to slide longitudinally in the direction of the arrow X and can be pressed in under the effect of spring loading into the needle bed at each of the multiplicity of tricks 17 of the needles and instruments of knitting needles (not shown). The needle plate 18, which with its front end (not shown, and in this case, the right hand end), lies against the knitting needle and lies there on the bottom of the trick 19, projecting with its left or rear end (shown in FIG. 1A) over a recess of the trick 21. Between the end of the needle plate 18 and an integral extension 22 of the needle plate 18 is arranged a needle plate butt 23, which can be pressed into the needle bed 16 or needle trick 17. The needle plate extension 22 is pressed by a leaf spring 26 supported at the bottom of the needle trick recess 21 against a stop 27 and an intermediate plate 28 arranged over it in the form of a trigger plate. The leaf spring 26 has a "U"-shaped scroll with a torus 29 on its end opposite the needle plate extension 22, which can engage, interlocking under the influence of the spring, into cutouts 31 on the underside of a stem 32 of the trigger plate 28 or retract from them. The stem 32 is pressed against a fixed plate 33. The trigger plate 28 can be moved longitudinally into four operating positions I–IV and can slide when selected in a manner which will be explained hereinafter, and in whose four parallel tracks the trigger plate butt 34, projecting from the needle bed can operate in conjunction with trigger cleats 37, 38, 39, 40 arranged on the cam box carriage 36, such that the trigger plate 28 can press into the needle bed 16 with its front plate zone 41 whereby it presses the needle plate extension 22 into the trick recess 21 against the effect of the leaf spring 26, so that the needle plate butt 23 also sinks/plunges into the needle bed 16 and needle trick 17. The longitudinal movement in the direction of the arrow X of the trigger plate 28 is achieved with the aid of two selector plates 46 and 47 which work together and are arranged one behind the other in the same needle trick 17. Both selector plates have basically the same longitudinal elongated form, being designed rocker shaped in order to be able to pivot about an apex zone 48, which lies on the plate 33 and on the bottom of the rear trick 19. The selector plates 46, 47 have a front return butt 51 and a forward projecting nib 52, plus a rear ejector butt 53 and a stepped rear stop 54 having longitudinally spaced striking surfaces 56 and 57. The front return butt 51 is constantly interlinked with the track 58 and 59 of a return cam part 61 and 62 on the cam box carriage 36. The opposite rear ejector butt 53 is movable in or out of the track 63 and 64 of the ejector cam part 66, 67 of the cam box carriage 36 according to the selection.

The selection of the first and the second selector plate 46, 47 is made with the aid of conventional electro-magnetic selection devices 13 and 14, of which the electromagnetically pivoting rockers 68 and a pivot arm 69 are depicted. The pivot arm 69 is provided with a butt 71 on the top side and lies with the underside on the front region of the selector plate 46 and 47. The pivot arm 69 is dependent on the pivot position of the selector plate 46, 47 with its butt 71 in or out of the plane of the bottom end of the rocker 68 arranged on the cam box carriage 36. As is customary, groups of, for example, six pivot arms 69 are arranged in each case next to each other, whose butts 71 are arranged offset to each other in the longitudinal direction within a group of pivot arms, so that the arrangement of the electro-magnetically operable rockers 68 of the a group of pivot arms depicted in FIG. 1 is achieved, which is associated with a group of selector plates.

According to the part illustrations 1A to 1D there are four differing operating positions as follows:

The nominal or first operating position I (FIG. 1A) is so arranged that both the first selector plate 46 and the second selector plate 47 are not selected by the rocker $68_1$, which means, that its most rear ejector butt 53 lies beneath and, as a result, out of the path 63, 64 of the ejector cam part 66, 67, such that the selector plates 46, 47 cannot be driven out i.e., ejected.

To achieve the second operating position II, as per FIG. 1B, only the front or first selector plate 46 is selected by the rocker $68_1$ and pressed downwards, enabling its ejector butt 53 to lie in a plate, level with the path/track 63 of the ejector cam part 66. Thus, as the cam box carriage 36 moves, this first selector plate 46 is driven forwards along the ejector cam track 63 to the operating position II. The rear or second selector plate 47 is in its non-selected position.

To achieve the third operating position III, (FIG. 1C), both the front first selector plate 46 and the rear second selector plate 47 are selected by the rocker $68_1$ and pressed down so that the ejector butt 53 of both of them lie at a level with the appropriate ejector cam track 63 and 64. According to FIG. 1C, the front nib 52 of the second selector plate 47 in this pivoted position is such that it lies beneath the rear left-hand striking face 56 opposite the right-hand striking face 57 set back in relation thereto. As the cam box carriage 36 moves, both the selector plates 46, 47 are initially ejected by the respective ejector cam part 66, 67, the first, selector plate 46 moving the trigger plate 28 into the operating position II before coming to rest. In contrast, the second selector plate 47 is ejected further, so that it arrives against the reset striking face 57 of the first selector plate 46 and thus pushes the first selector plate 46 once again, such that the trigger plate 28 is moved on into position III.

To achieve the operating position IV, according to FIG. 10, the first selector plate 46 is not selected and the second selector plate 47 is selected by the rocker $68_1$ and pressed down so that only its ejector butt 53 lies at a plane level with the ejector cam track 64. With the first selector plate 46 in this non-selected pivot position, its rear left-hand striking face 56 lies directly opposite the nib 52 of the second selector plate 47. This means that as the cam box carriage 36 moves, the ejector butt 53 of the second selector plate 47 is pushed in the direction of the arrow X and the first selector 46 is carried directly with it. The ejector cam track 64, linked immediately and directly with the first selector plate 46, as well as with the second plate 47, pushes the trigger plate 28 from the position I into the most forward operating position IV.

Figures 1D, 2A, 2B:
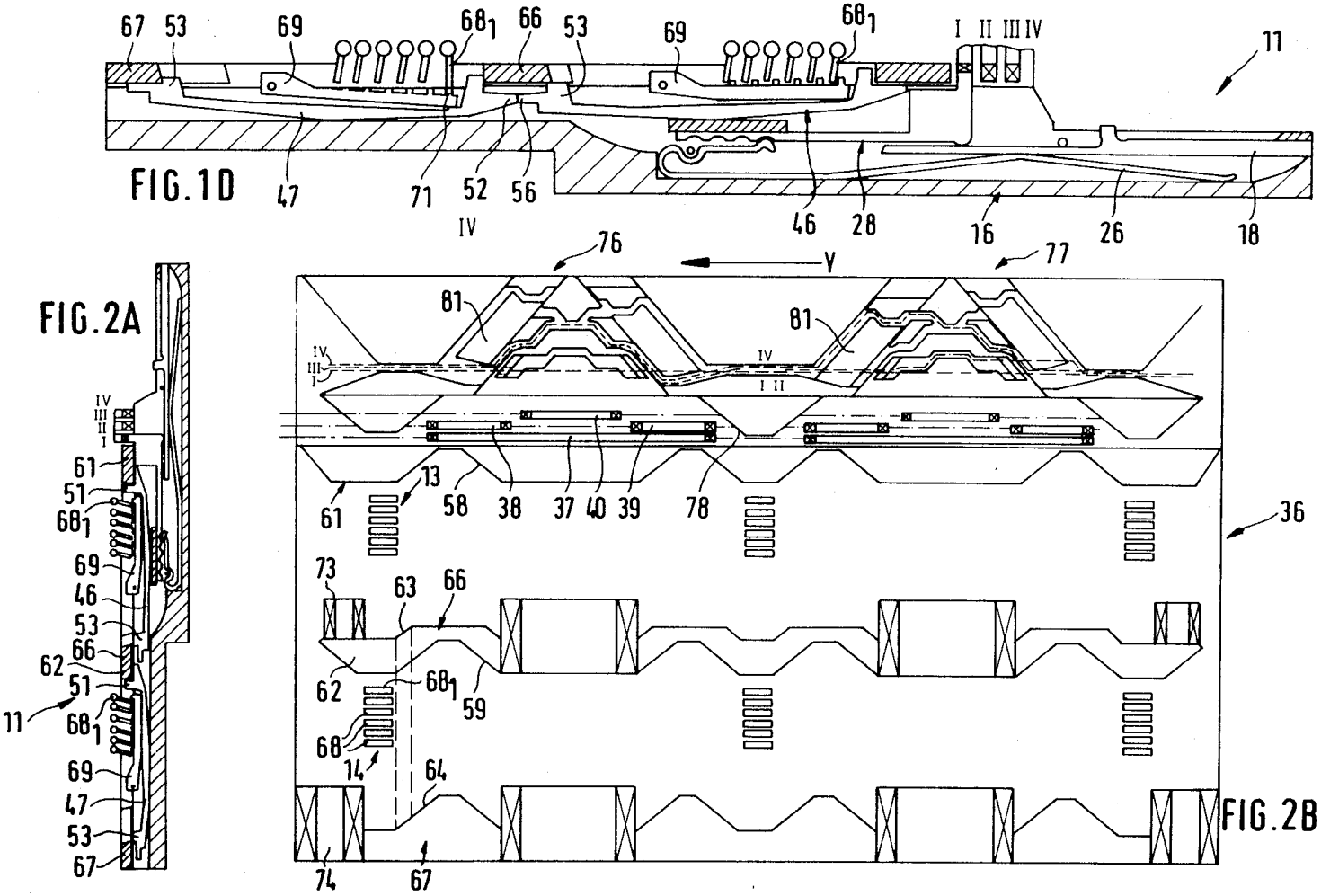
FIGS. 2A to 2B: illustrate in reduced pictorial presentation the mechanism according to FIGS. 1A–1D in the nominal position of the part illustrated in FIG. 1A and a plan view of a carriage provided with a double cam arrangement.

FIG. 2B shows the cam parts and the cams on the cam box carriage 36 relative to the arrangement of the selector plates 46, 47 in FIG. 2A. FIG. 2B shows the respective cam heights of the ejector cam tracks 63 and 64. Both ejector cam tracks 63 and 64 start at the same level and therefore at the same point in the movement of the cam box carriage 36, but the cam height of the rear ejector cam track 64 is greater than that of the front ejector cam track 63, the cam height of the rear ejector cam track 64 corresponding to the distance between the nominal position I and the operating position IV, while the cam height of the front ejector cam track 63 represents the distance between the nominal position I and the second operating position II. This means that the distance between the rear striking face 56 and the set back front striking face 57 of the first selector plate 46 is the same as the distance between the third operating position III and the fourth operating position IV. In the exemplary arrangement the distances are equal between the individual neighboring operating positions I, II, III and IV.

It is also clear from FIG. 2B that the return cam tracks 58 and 59 are basically identical to each other and that the rear return cam track 59 is arranged relative to the same cam part 66, 62 as is the case for the ejector cam track 63 arranged relative to the first selector 46. In addition, at the side of the two cams 76, 77 there are cam tracks 78 for resetting the butt 34 of the intermediate plate 28 to position I.

It is also evident that along the course of the ejector cam tracks are "offer elements" 73, 74 for the first selector plate 46 and the second selector plate 47, respectively. These "offer elements" 73, 74 are used to bring the selector plates 46, 47 and their pivot arms 69 into the "offer" position in relation to the electro-magnetic selection device 13, 14 before the selector plates 46, 47 are selected. This "offer" position is identical to the non-selected position in accordance with illustrations of FIGS. 1A and 2A. This means that, when the cam box carriage 36 with the "offer elements" 73, 74 pass over the ejector butts 53 of the selector plates 46, 47, the latter are all tilted into the position shown in FIGS. 1A and 2A, such that the butts 71 of the pivot arms 69 arrive at or above a plane, level with the lower ends of the rockers 68. If the rocker 68 remains in the diagonal position shown in FIG. 2A, the appropriate pivot arm butt 71 remains outside the path of the rocker end and therefore the selector plate remains unselected. If, on the other hand, the rocker $68_1$ is tilted, the butt 71 of the respective pivot arm 69 lies in its path, so that the pivot arm is pressed down and tilted by the rocker end 68 as it travels over, by means of the cam box carriage 36 and this results in a tilting movement of the relevant selector plate 46, 47. According to FIG. 2B, the "offer elements" 73, 74 are provided at both ends with oblique camming faces so that they are operable for both directions of movement of the cam box carriage 36.

FIG. 2B shows a cam box carriage 36 which has two identical combined cams 76, 77, which feature both a knitting cam part and a transfer cam part, which require no further explanation. Accordingly, the "offer elements", the ejector cam parts, the return/resetting cam parts and the electro-magnetic selection devices are arranged at both outer ends of the combined cams 76, 77 and between the cams 76, 77. In the right to left direction of movement Y of the cam box carriage 36, the "offer elements" 73, 74 are initially arranged, followed by the electro-magnetic selection devices 13, 14, and then the ejector cam parts 66, 67. During the knitting operation of the knitting needles and their needle plates there are more "offer elements" 73, 74 directly below the combined cams for the return pivoting of the selector plates 46, 47 for a further selection operation at a later point in time. Adjacent to these are the return cam parts 58, 61, 62 at the end of the preceding combined cam 76, and these are again followed by the electro-magnetic selection devices 13, 14, which in turn are followed by further ejector cam parts 66, 67 at the beginning of the trailing combined cam 77, which once again in the area of the trailing combined cam 77 are followed by more "offer elements" 73, 74. The "offer elements" 73, 74 are followed at the end of the trailing combined cam by yet more return cam parts 61, 62. The following electro-magnetic devices 13, 14 and "offer elements" 73, 74 are provided for the opposite direction for offering and selecting for the preceding combined cam 77.

FIG. 2B also shows trigger cleats 37 to 40 beneath each combined cam 76, 77, which are arranged in the path of the various operating positions I–IV to ensure that the trigger plate 28 and thus the butt 23 of the needle plate 18 is sunk into the needle bed. The trigger cleats 37 to 40 are not, wholly or in part, arranged over the length of the combined cam 76, 77. The trigger cleats 37 to 40 are arranged, for example, such that in the nominal position I the needle plate butts are always depressed, in other words, they are in the non-operative position. In the operating position II the relevant butts are only partially depressed, such that the needles arrive in the loop transfer acceptance position. In the operating psoition III the needle tucks are under partial depression only. In the operating position IV the needles either knit or the stitch is transferred to the needle of the other needle bed, a choice which is made here, for example, by movement of the knitting cam 81. It is, however, also possible here to make the trigger cleats 37 to 40 switch, so that a further selection is possible.

In the exemplary embodiment of this invention depicted in FIGS. 3A–3D, the selector plates 46', 47' are also arranged one behind the other, but associated only to a single ejector cam part 66'. In this version, the selector plates 46', 47' are designed also in the form of a twin-arm levers and are located to pivot by means of a round protrusion 83 projecting from its underside into a connector plate 84, whereby they are arranged opposite each other to move in a counteracting manner, differently to that given in the first embodiment. The selector plates 46', 47' are, in this case, each provided directly with a butt 71' which acts during selection with the rocker 68 of the electro-magnetic selection devices 13, 14. The connector plate 84 is located to move longitudinally in the needle bed trick 17' and lies on the front stem part 85 of a drive plate 86, which is arranged on the bottom of the needle trick 17' in such a way that it can move in a longitudinal manner. The drive plate 86 is provided with a butt 87 at its rear end with a striking face 88 spaced at a distance opposite an end face 89 of the connector plate 84. The other end face 90 of the connector plate 84 lies at a distance opposite a striking face 91 of an intermediate plate 28', which is for taking up the various operating positions I–IV.

Figure 3A:
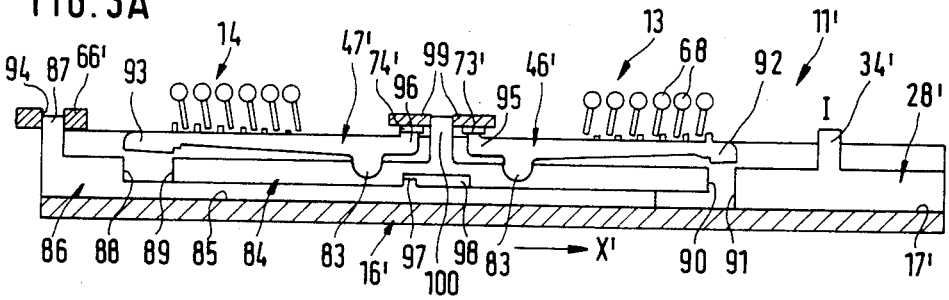
FIGS. 3A to 3D: illustrates in longitudinal section, a mechanism for selecting various operating positions of the knitting needles of a flat-bed knitting machine, according to a second preferred embodiment of the invention, for which the differing operating positions are also depicted in the part illustrations.

The selector plates 46', 47' have a butt 92 and 93, respectively, which project downwardly and are on the end opposite the longer arms, which lie opposite the respective gap between the drive plate 86 and the connector plate 84 on the one hand, or the connector plate 84 and the intermediate plate 28' on the other hand, in the nominal position or "offer" position of the drive plate and connector plate (FIG. 3A). Both butts 92 and 93 have differing widths, for example, at a ratio 1:2 which corresponds equally to the width of the mentioned gap between the relevant plates in the nominal position.

According to FIG. 4, the butt 87 of the drive plate 86 is guided into a cam track 94 of the cam part 66', which in combination, contains the ejector cam track and the return cam track, so that a constant back-and-forth movement of the drive plate 86 occurs as the cam box carriage travels past, due to this enforced guidance. An interlink between the drive plate 86 and the intermediate plate 28' via the connector plate 84 is only achieved when at least one of the selector plates 46', 47' (or both) with its butt 92, 93 is pressed inbetween the drive plate 86 and the connector plate 84, respectively between the connector plate 84 and the intermediate plate 28' by the rocker $68'_1$.

Figure 4A:
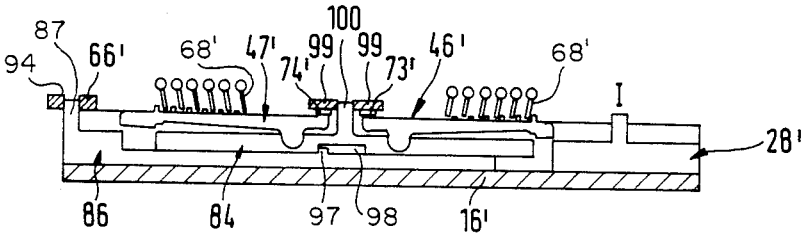
FIGS. 4A to 4B: illustrate in reduced pictorial presentation a mechanism according to FIGS. 3A–3D in the nominal position as per FIG. 3A and in schematic plan on a part of a carraige having a double cam arrangement.
Figure 4B:
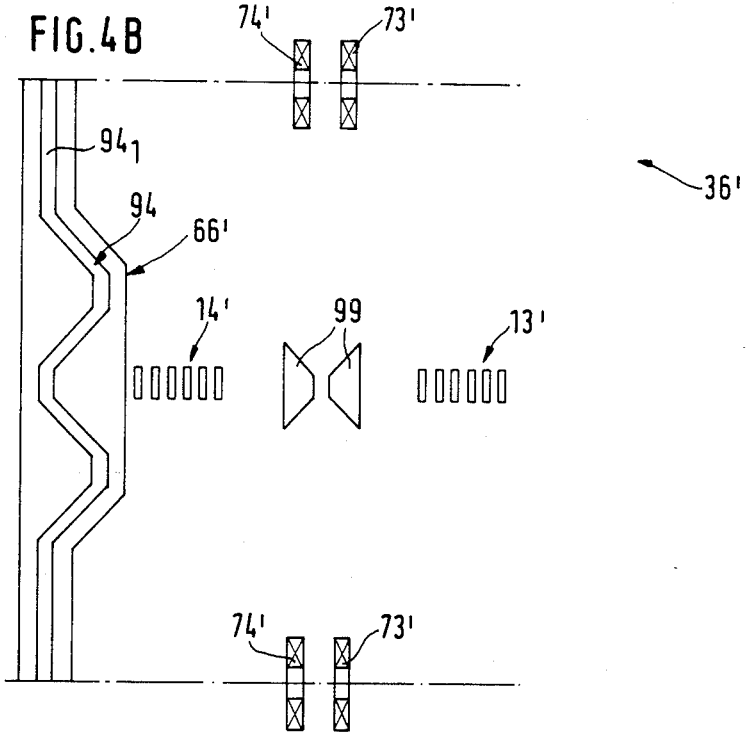

This results in the following selection:

According to FIG. 4B, the selector plates 46', 47' are initially moved via the preceding 'offer elements" 73', 74' on the cam box carriage 36' into their position depicted in FIGS. 3A and 4A by joihtly operating with the short lever arms 95, 96 projecting from the needle bed 16'. During this offer movement the drive plate 86 is in its rear most nominal position corresponding to the region of the track $94_1$. During the movement into this position the connector plate 84 has been drawn back by the drive plate 86 via a nib 97 which meshes in a groove 98 provided on the underside of the connector plate 84. The drive plate 86 is in this nominal position even when the electro-magnetic selection devices 13, 14 arrive via the butts 71' of the selector plates 46',47'. A centering part 99 is also arranged on the cam box carriage 36' at the height of the selector devices 13, 14, which effects transverse centering of the connector plate 84 by acceptance of a center butt 100 projecting from the needle bed 16'. During further progression of the cam box carriage 36' the drive plate 86 is pushed forwards according to the form of the cam track 94 in the direction of the arrow X'.

Figure 3B:
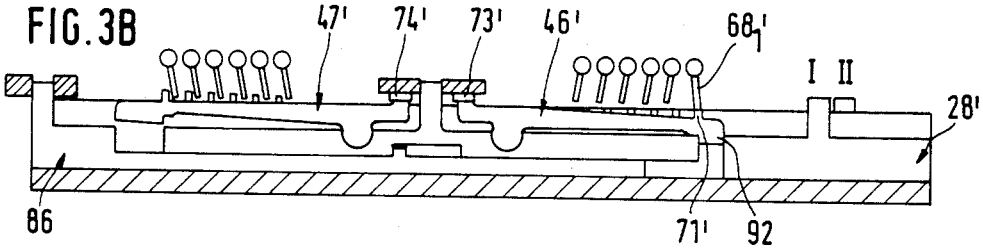

If the first selector plate 46' is selected in accordance with FIG. 3B, i.e., pressed into the gap between the connector plate 84 and the intermediate plate 28' by the actuated rocker $68'_1$, then an idle stroke of the drive plate 86 is effected until its striking face 88 lies on the rear end face 89 of the connector plate 84, upon which the connector plate 84 as well as the intermediate plate 28' are pushed in the direction of arrow X'. Since the width of the butt 92 is equal to the distance of the operating positions I and II, movement of the intermediate plate 28' occurs through to this operating position II.

Figure 3C:
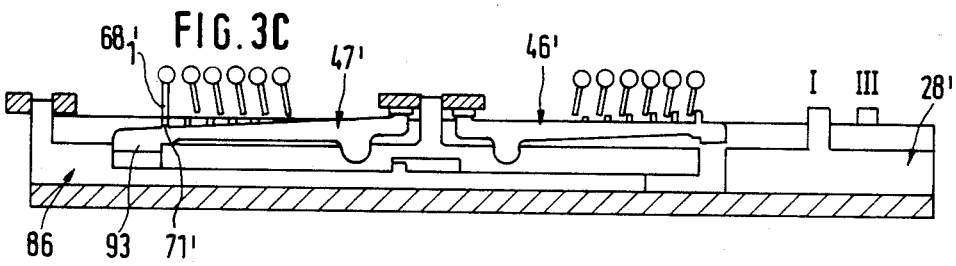

In accordance with FIG. 3C, the second selector plate 47' has been selected and the first selector plate 46' not selected. Then the connector plate 84 moves immediately with the drive plate 86 in the direction of the arrow X', in the course of which the intermediate plate 28', however, is only moved after completion of the idling stroke for the width of the corresponding gap. Because the butt 93 is double the width of the butt 92, movement from the nominal position I to the third operating position III is thus effected.

Figure 3D:
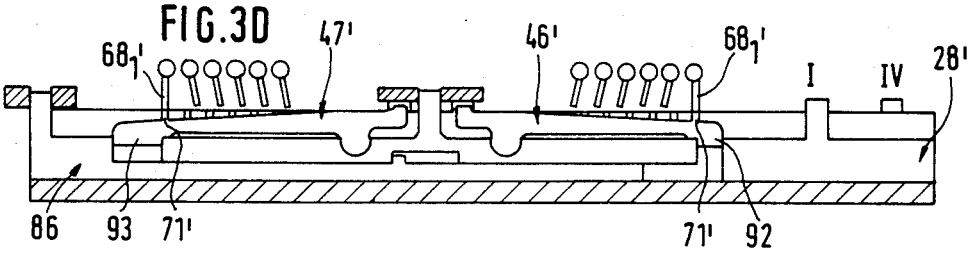

According to FIG. 3D, the first selector plate 46' and the second selector plate 47' are selected, i.e., the butt 92 lies between the intermediate plate 28' and the connector plate 84 and the butt 93 lies at the same time between the connector plate 84 and the drive plate 86. This means that with the movement of the drive plate 86 not only is the connector plate moved, but also the intermediate plate 28' is moved immediately, and for a path which corresponds to the addition of the widths of the butts 92 and 93, which is equal to the path from the nominal position I to the fourth operating position IV.

After the selected shift of the intermediate plate 28' into the respective operating position I, II, III or IV, the drive plate 86 is again drawn back into the nominal position, during which the connector plate 84 is moves via nib 97. Immediately following this an "offer" movement is once again effected of the selector plates 46', 47' by means of further "offer elements" 73', 74'.

Figure 5:
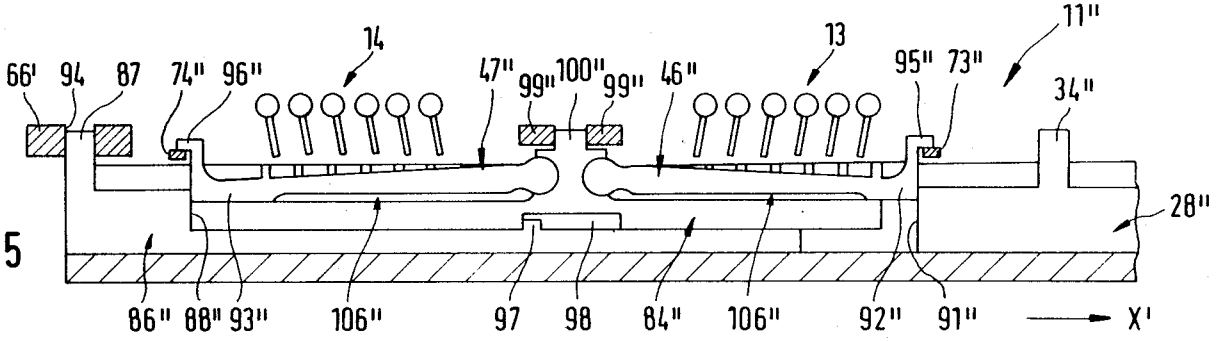
FIG. 5: illustrates a first variant of the mechanism according to FIGS. 3A–3D.

The first variant depicted in FIG. 5 of the second exemplary embodiment of FIGS. 3 and 4 differs in so far as the selector plates 46'', 47'' are located to pivot in the butt 100'' of the connector plate 84'' in opposite positioned mountings as single-arm levers at their ends facing each other, such that the transmission of movement from the drive plate 86'' to the intermediate plate 28'' can occur via the fully selected selector plate 46'' and/or 47'' (not just via the respective butt 92'' and/or 93''). In addition the striking face 88'' of the drive plate 86'' and the striking face 91'' of the intermediate plate 28'' have been extended beyond the level of the top surface 106'' of the connector plate 84'', so that the selected selector plate 46'' and/or 47'' with its butt 92'', 93'', respectively, lies against the striking face 88'', 91'', respectively but also on the mentioned top surface 106'' of the connector plate 84'', instead of penetrating into the gap between the plates 86'', 84'' and 84'', 28''. The width ratio of, for example, 1:2 between the gaps is provided as before, as FIG. 5 clearly shows, in which, as in FIG. 3D, both selector plates have been shown selected. Furthermore, there is a difference in that the "offer motion" of the selector plates 46'', 47'' is effectcd by the co-operation of protrusions 95'', 96'' arranged on the outer free end of the selector plates and correspondingly offer elements 73'', 74'' provided on the cam box carriage.

Figure 6:
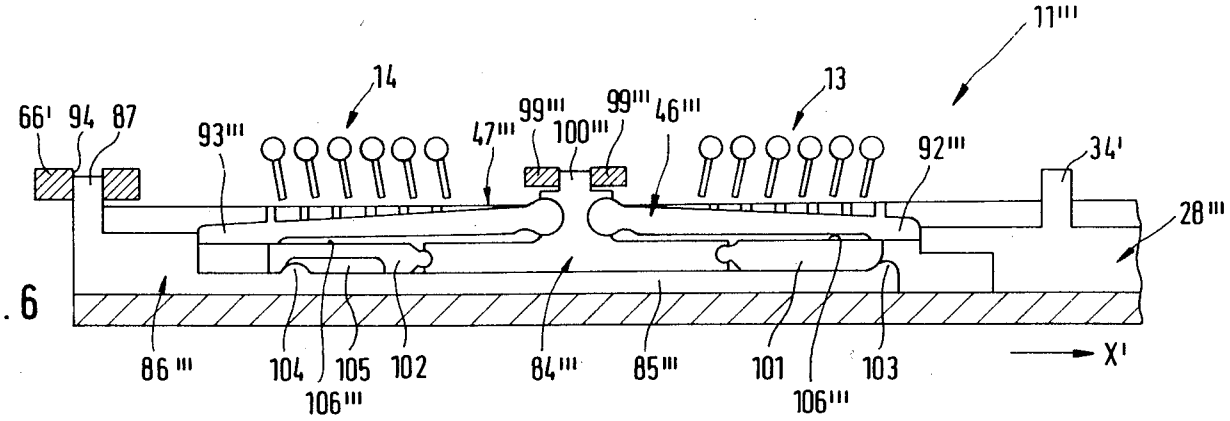
FIG. 6: illustrates a second variant of the mechanism according to FIGS. 3A–3D.

In the second variant depicted in FIG. 6 for the exemplary embodiment as per FIGS. 3 and 4, single-arm selector plates 46''', 47''' are also provided, which are located to pivot in the butt 100''' of the connector plate 84'''. This variant differs from the variant of FIG. 5 merely in the type of arrangement of the "offer motion" of the selector plates 46''', 47''', while the transmission of motion described in FIG. 5 by the complete selector plate 46''', 47''' also applies here. As can be seen in FIG. 6, the connector plate 84''' is provided with flaps 101 and 102 at each end located in one side, which in the nominal or rest condition lies on the stem part 85''' of the drive plate 86'''. In the illustration corresponding to FIG. 5, the flap 101 is situated in the gap between the intermediate plate 28''' and the connector plate 84''' and the flap 102 is situated between the other end of the connector plate 84''' and the opposite striking face of the drive plate 86'''. A knob 103 on the end of flap 101 projects from the stem part 85''' of the drive plate 86''' and a corresponding knob 104 of the flap 102 on the left-hand end lies in a groove 105 machined in the flap 102. Although not illustrated, the track 94 is now provided with a zone/region which is directed against operating motion in direction X', which means that when the butt 87 of the drive plate 86''' executes this motion, the knobs 103, 104, the flaps 101 and 102, lift upwards, because the connector plate 84''' is securely retained in the transverse fixing 99''', so that the "offer motion" of the selector plates 46'''. 47''' is thereby effected. In other words, the height of the knobs 103 and 104 corresponds to the magnitude of the movement necessary for the selector plate 46''', 47''' from the selected position.

For those examples illustrated in FIGS. 3 to 6, the question of an intermediate plate 28', 28'', 28''' pushed into the relevant operating position, in each case, can either be a trigger plate, as in the example of FIGS. 1 and 2, or a jacking instrument, which operates directly on the knitting needle and whose butt then operates together with a cam having switching cam parts or the knitting needle pushes slides in defined cam tracks having fixed cam parts.

According to a further exemplary embodiment of the invention shown in FIG. 7, the mechanism 111 is provided with selector plates 146, 147, which are arranged directly side-by-side against each other. The selector plates 146, 147 are arranged in a common needle bed trick 117 and operate on a common trigger plate 128, which is arranged in the same manner as FIGS. 1 and 2. The selector plates 146, 147 have differing lengths and an echeloned arrangement of its rear drive butts 153, directly or indirectly operate together with a common ejector cam track 163 of an ejector cam part 166. One of the selector plates 147, which is shorter than the selector plate 146, has a hook 155 on its rear end, which hooks behind the rear and of the other selector plate 146, by means of which the two selector plates 146, 147 are interlinked in a certain position relative to each other in the direction of movement X''. The selector plates 146, 147 have a similar form like those of FIGS. 1 and 2, that means, they are provided with an apex region 148, which is asymmetrically positioned and lies on the plate 133 and thus enables a rocking motion of the selector plate to take place.

Figure 7A:
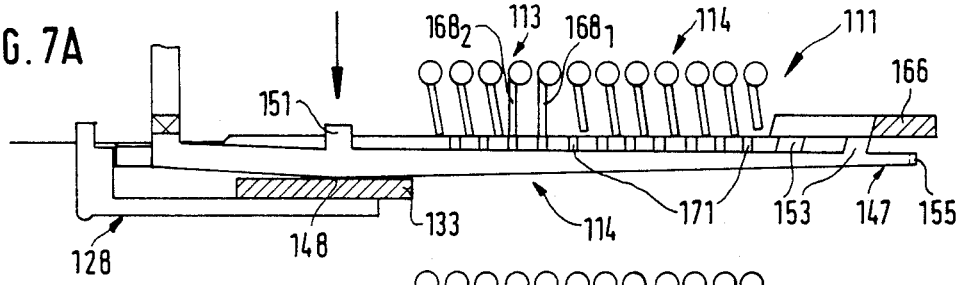
FIGS. 7A to 7D: illustrate a mechanism in longitudinal section for selecting various positions of the knitting needles on flat-bed knitting machines in accordance with a third preferred embodiment of the invention, for which the differing operating positions are depicted.
Figure 7B:
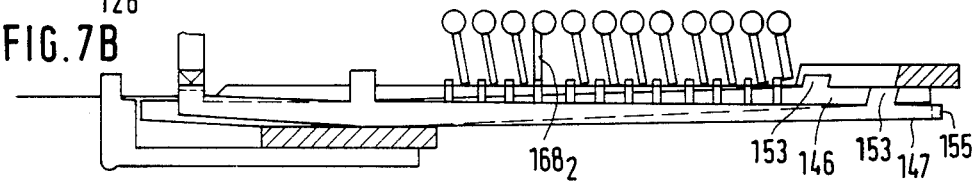
Figure 7C:
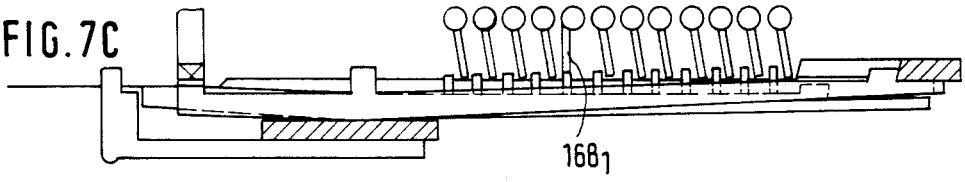
Figure 7D:
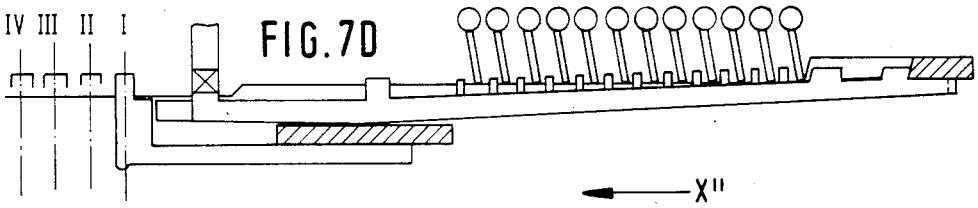
Figure 8:
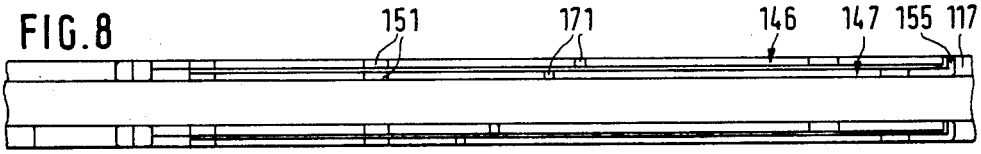
FIG. 8: illustrates a sectionalized plan view on the mechanism of FIGS. 7A–7D viewed in the direction of arrow VIII of FIG. 7A, and FIG. 9: illustrates a sectionalized plan view in simplified presentation of a cam box carriage.

Since the selector plates 146 and 147, as FIG. 8 shows, are arranged immediately next to each other, the corresponding group of electro-magnetic selection devices 113, 114, and/or the opposite butts 171 are arranged offset in groups to the selector plates 146, 147 in the longitudinal direction of the selector plates. The "offer motion" and subsequent selections occurs in the same way as for the previous exemplary embodiments, in which the differing operating positions I to IV are retained or achieved as follows:

FIG. 7D shows the nominal position after the "offer motion" of both selector plates 146, 147 has been completed, which corresponds to the selected position in which, in contrast to previous examples, the selector plate 147 is in cooperation with the track/path 163 of the ejector cam part 166 and the selector plate 146 through contact with its rear end on the selector plate 146 through contact with its rear end on the hook 155 is in cooperation with the selector plate 147. If the selector plate 147 is driven out therefore by the moving of the ejector cam track 163 by means of a cam box carriage 136 (FIG. 9), then the selector plate 146 is immediately moved with it together with the trigger plate 128. The height of the ejector cam track 163 corresponds with the distance between the nominal and/or operating position I and the fourth operation position IV.

According to FIG. 7C only the selector plate 146 is selected via the rocker $168_1$ and pressed down and, because its rear end is pivoted out of the zone of the hook 155 of the selector plate 147, is no longer interlinked for operable drive. Since the selector plate 147 is shorter, and as a result, features a space in relation to the trigger plate 128, an idle motion of this selector plate 147 initially occurs for a certain period until the trigger plate 128 is then carried with it and brought into the third operating position III. In other words, the magnitude of the idling motion corresponds to the distance between the operating positions IV and III.

According to FIG. 7B, the first selector plate 146 is not selected and pressed down and the second selector plate 147 is selected and pressed down via the rocker $168_2$, so that its ejector butt 153 dips below the track 163. Because the ejector butt 153 of the selector plate 146 from the deepest point of the ejector cam track 163 features a space which corresponds to double the distance of two neighboring operating positions and the two selector plates 146, 147 are not intercoupled, the ejector butt 153 does not arrive in contact with this until after a certain idling of the ejector cam track 163, so that the trigger plate 128 is only shifted by one position, i.e. into the operating position II.

FIG. 7A shows the case, in which neither the first selector plate 146 nor the second selector plate 147 remained in the "offer position", in other words, have been selected. In these positions the ejector butt 153 of both selector plates 146 and 147 is out of the zone, i.e. beneath the ejector cam part 166. As a result, there is no shifting of the trigger plate 128.

Figure 9:
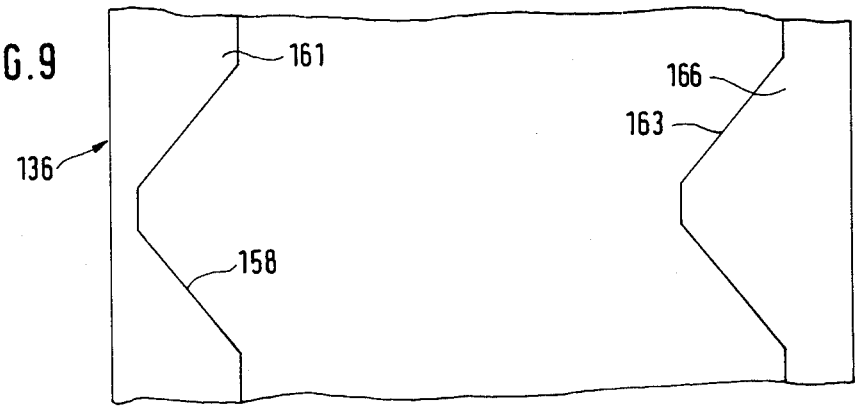

FIG. 9 shows the uniform ejector cam track 163 common to both selector plates and a correspondingly similar and mutually common return cam track 158 at a return cam part 161, the latter of which operates together with the two selector plates 146 and 147 with return butts 151 lying at the same height.

It is possible even for this exemplary embodiment to allow the selector plates to operate on jacking plates instead of on trigger plates and to provide corresponding cams in the cam box carriage.

All the exemplary embodiments described can be further refined/developed by third and/or addition selector plates, so that the number of combinations of selection is greater.

What is claimed is:

1. A flat-bed knitting machine, comprising:

a plurality of needle beds in each of which longitudinally extending needle tricks are formed;

cam track means operatively associated with the needle beds;

an intermediate plate located in each needle bed and situated to move longitudinally in the needle track to control the longitudinal movement of the needle associated with the respective needle bed;

a first and second selector plate located in each needle bed; and an electro-magnetic selecting devide operatively associated with the selector plates, wherein:

the electro-magnetic selecting device controls the location of the selector plates, as a function of the knit pattern, relative to the cam track means and their associated intermediate plate; and the longitudinal movement of the intermediate plates extend from a nominal or first operating position immediately to one of at least three further operating positions as a function of the location of the associated selector plates.

2. The flat-bed knitting machine is defined in claim 1, further wherein:

the selector plates and the intermediate plate in each needle bed are aligned in a row in the longitudinal direction with the second selector plate situated between the first selector plate and the intermediate plate.

3. The flat-bed knitting machine is defined in claim 2, further wherein:

the cam track means includes a first ejector cam track and a second ejector cam track whose ejector cam heights differ; and the first selector plate is associated with the first ejector cam track and the second selector plate is associated with the second ejector cam track.

4. The flat-bed knitting machine as defined in claim 3, further wherein:

the cam track height of the first ejector cam track is equal to the distance between the first or nominal operating position and the second operating position of the intermediate plate.

5. The flat-bed knitting machine as defined in claim 3, further wherein:

the cam height of the second ejector cam track is equal to the distance between the first or nominal operating position and the fourth operating position of the intermediate plate.

6. The flat-bed knitting machine as defined in claim 3, further wherein:

the end of the first selector plate adjacent to the second selector plate is provided with echelonedstepped striking surfaces which are engageable with the end of the second selector plate, the pitch of the echeloned-stepped striking surfaces corresponding to that of the third and fourth operating position of the intermediate plate; and neither selector plate is actuated to retain the first or nominal operating position, the first selector plate is actuated to obtain the second operating position, the first and second selector plates are actuated to obtain the third operating position, and the second selector plate is actuated to obtain the fourth operating position.

7. The flat-bed knitting machine as defined in claim 3, further wherein:

the cam track means includes a cam part which defines at one end the first ejector cam track and defines at the other end a return/retracting cam track; and the first ejector cam track being engageable with the first selector plate and the return/retracting cam track being engageable with the second selector plate.

8. The flat-bed knitting machine as defined in claim 3, further comprising:

offer elements, further wherein:

the cam track means include two cam parts, one defining the first ejector cam track and the other defining the second ejector cam track; and the offer elements are associated with each cam part for the selection of the first and second selector plate.

9. The flat-bed knitting machine as defined in claim 3, further wherein:

each selector plate comprises a twin-arm lever; and each selector plate is located in the needle bed to be out of mesh with the cam track means in the offer position of selection corresponding to the first or nominal operating position.

10. The flat-bed knitting machine as defined in claim 2, furthur wherein:

the cam track means includes an ejector cam track; and the ejector cam track is situated between the selector plates.

11. The flat-bed knitting machine as defined in claim 10, further comprising:

a connector plate located in each needle bed and situated to move longitudinally in the needle track; and a drive plate located in each needle bed and connected to the cam track means, and situated to move longitudinally in the needle track to effect the longitudinal movement of the connector plate, further wherein:

the selector plates are connected to the connector plate.

12. The flat-bed knitting machine as defined in claim 11, further wherein:

the cam track means includes a cam part which defines at one end an ejector cam track and at the other end a return cam track; and the drive plate is intermeshed with both cam tracks.

13. The flat-bed knitting machine as defined in claim 12, further wherein:

the connector plate can be interlinked for movement by means of the first selector plate and the drive plate.

14. The flat-bed knitting machine as defined in claim 12, further wherein:

the connector plate can be interlinked for movement by means of the second selector plate and the drive plate.

15. The flat-bed knitting machine as defined in claim 12, further wherein:

the connector plate can be interlinked for movement by means of the first and second plate and the drive plate.

16. The flat-bed knitting machine as defined in claim 12, further wherein:

the selector plates are disposed so that one of said selector plates meshes in an interlocking manner between the drive plate and one end of the connector plate, and the other of said selector plates meshes in an interlocking manner between the other end of the connector plate and the intermediate plate.

17. The flat-bed knitting machineas defined in claim 16, further wherein:

the selector plates include butts of differing widths with the ratio of said widths of said first selector plate to said second selector plate being preferably 1:2;

the butts serve to mesh between the drive plate and connector plate and between the connector plate and the intermediate plate.

18. The flat-bed knitting machine as defined in claim 17, further wherein:

the butts are meshed simultaneously.

19. The flat-bed knitting machine as defined in claim 17, further wherein:

the butts are meshed individually.

20. The flat-bed knitting machine as defined in claim 11, further wherein:

both selector plates are pivotably mounted to the connector plate.

21. The flat-bed knitting machine as defined in claim 20, further comprising:

offer elements, further wherein:

both selector plates are formed as twin-arm levers, the short arms of each facing each other, operate together with the offer elements for the selection.

22. The flat-bed knitting machine as defined in claim 20, further wherein:

both selector plates are formed as single-arm levers.

23. The flat-bed knitting machine as defined in claim 22, further comprising:

offer elements, further wherein:

the single-arm levers each include a projection opposite its butt on its free end, which operates together with the offer elements for a selection.

24. The flat-bed knitting machine as defined in claim 22, further comprising:

offer elements, further wherein:

the movement for offering of the selector plates is achieved by an opposite movement of the drive plate to that of the direction of feed.

25. The flat-bed knitting machine as defined in claim 24, further wherein:

knobs are provided at the base of the drive plate;

the connector plate is provided with a flap beneath the selector plates on which the selector plates lie; and the connector plate flaps are pivoted via said knobs during the appropriate offering action of the drive plate.

26. The flat-bed knitting machine as defined in claim 11, further wherein:

the cam track means includes a centering part arranged to the height of movement of the selection device; and the connector plate includes a butt which projects from the needle bed and operates together with the centering butt.

27. The flat-bed knitting machine as defined in claim 1, further wherein:

the selector plates are arranged parallel and next to each other in a transverse direction to the longitudinal direction of movement of the needles and operate on a common intermediate plate.

28. The flat-bed knitting machine as defined in claim 27, further wherein: the selector plates are of differing lengths.

29. The flat-bed knitting machine as defined in claim 27, further wherein:

the second selector plate is provided with a transverse offset hook at its rear end with which the first selector plate can be connected for movement.

30. The flat-bed knitting machine as defined in claim 27, further wherein:

the cam track means includes an ejector cam track; and both selector plates are operatively associated with the ejector cam track.

31. The flat-bed knitting machine as defined in claim 30, further wherein:

each selector plate includes a butt which operates with the ejector cam track; and the butts are arranged at a pitch from each other.

32. The flat-bed knitting machine as defined in claim 27, further wherein:

both selector plates are selected for the nominal or first operating position;

the first selector plate is selected for obtaining the third operating position;

the second selector plate is selected for obtaining the second operating position; and neither selector plate is selected for obtaining the fourth operating position as both are connected together for movement.

33. The flat-bed knitting machine as defined in claim 11, further wherein:

the intermediate plate comprises a needle jack; and the butts of the individual plates lie in the planes of the feeder tracks for the cam track means.

34. The flat-bed knitting machine as defined in claim 11, further comprising:

trigger cleats, further wherein:

the intermediate plates comprise trigger plates each with a butt; and the differing paths described by the trigger butts are arranged in the planes of the trigger cleats.

35. The flat-bed knitting machine as defined in claim 34, further wherein:

the trigger cleats are switchable.

* * * * *